United States Patent [19]

Fujioka

[11] Patent Number: 4,595,304

[45] Date of Patent: Jun. 17, 1986

[54] HAMMER ASSEMBLY FOR PRINTERS

[75] Inventor: Satoshi Fujioka, Shiojiri, Japan

[73] Assignee: Seiko Epson Corporation, Tokyo, Japan

[21] Appl. No.: 755,531

[22] Filed: Jul. 12, 1985

Related U.S. Application Data

[63] Continuation of Ser. No. 608,284, May 8, 1984, abandoned.

[30] Foreign Application Priority Data

May 10, 1983 [JP] Japan ..... 58-69390[U]

[51] Int. Cl.[4] ..... B41J 9/06; B41J 9/38

[52] U.S. Cl. ..... 400/157.2; 101/93.34; 101/93.48

[58] Field of Search ..... 400/157.2; 101/93.29, 101/93.32, 93.33, 93.34, 93.42, 93.43, 93.48; 335/258, 259, 261, 267

[56] References Cited

U.S. PATENT DOCUMENTS 1,361,935 12/1920 Villiers ..... 335/258
4,422,784 12/1983 Arzoumanian et al. ..... 400/157.2 X

FOREIGN PATENT DOCUMENTS 87583 7/1980 Japan ..... 101/93.29
38149 3/1982 Japan ..... 400/157.2
212081 12/1982 Japan ..... 101/93.48

*Primary Examiner*—Charles A. Pearson
*Attorney, Agent, or Firm*—Blum Kaplan Friedman Silberman & Beran

[57] ABSTRACT

A plunger type electromagnetic hammer assembly for use with a printer including a hammer housing having a magnetic flux emitting surface. The hammer assembly includes a hammer slidably situated in the housing wherein the hammer includes a plunger portion having a first radius and a head portion having a second radius. The plunger portion and the head portion are coupled by a neck portion having a third radius, the third radius being less than the first radius and than the second radius. The plunger, neck and head portions are coaxially oriented. A biasing structure biases the hammer away from the platen. A magnetic flux on the magnetic flux emitting surface causes the hammer to slide toward the platen.

7 Claims, 3 Drawing Figures

HAMMER ASSEMBLY FOR PRINTERS

This is a continuation of application Ser. No. 06/608,284, filed May 8, 1984, now abandoned.

BACKGROUND OF THE INVENTION

The present invention is generally directed to a plunger type electromagnetic hammer for use with printers using type indicia and, in particular to a hammer structure for use in an electromagnetic hammer assembly wherein the plunger and head portions of the electromagnetic hammer are made of the same electromagnetic material.

Reference is made to FIG. 1 wherein a hammer assembly of the electromagnetic hammer type according to the prior art is shown. The plunger and head portions are made of the same electromagnetic material because of cost and size restrictions. The prior art hammer consists of a plunger portion 101 and a head portion 103 at the leading end of plunger portion 101, the head portion 103 being the same size as a type element. The radial distance Y' between the portion 103 and yoke member 104 is smaller than the longitudinal distance X' from the magnetism introducing face 117 of plunger 101 to the end of a coil 109 in yoke 104.

The result of this configuration is that magnetic leakage occurs at the portion of head portion 103 near plunger portion 101. This reduces the magnetic flux available to thrust plunger portion 101 in the direction of arrow 120. Because of the magnetic leakage, the efficiency of the hammer is lowered and the heat released is increased. In addition, the hammer in accordance with the prior art cannot respond at high frequency levels and desired impact energies are not generated.

Accordingly, there is a need for a print hammer in which the efficiency of the magnetic circuit of the electromagnetic hammer assembly is enhanced to insure a high frequency response at a low power consumption with a high impact energy.

SUMMARY OF THE INVENTION

Generally speaking, in accordance with the instant invention, a plunger type electromagnetic hammer assembly for printing against a platen in a printer with a hammer housing having a magnetic flux emitting surface is provided. The hammer assembly includes a hammer slidably situated in the housing and includes a plunger section having a first radius biased away from the platen, a coaxial head section having a second radius, and a neck section having a third radius less than the first radius and than the second radius. Magnetic flux on the magnetic flux emitting surface causes the hammer to slide toward the printer.

Accordingly, it is an object of the invention to provide an improved hammer assembly for printers.

Another object of the invention is to provide an improved hammer assembly for printers wherein the plunger and hammer portions are made of the same electromagnetic material.

A further object of the invention is to provide a plunger type electromagnetic hammer wherein efficient use is made of the magnetic flux to thrust the plunger portion.

Yet a further object of the invention is to provide a plunger type electromagnetic hammer assembly which can operate at high frequency with a low power consumption and high impact energy.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
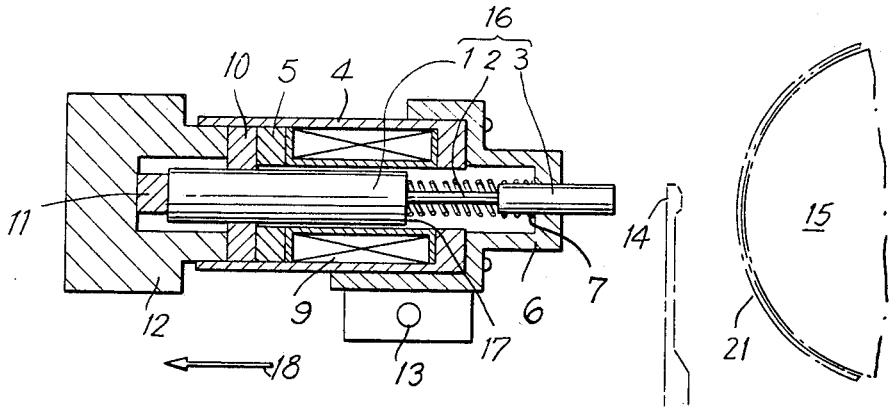
FIG. 2 is a cross-sectional view of a hammer assembly constructed in accordance with an embodiment of the present invention.

Reference is first made to FIG. 2 wherein a plunger type electromagnetic hammer assembly in accordance with the invention is depicted. A hammer 16 is integrally constructed of a plunger portion 1, a neck portion 2 and a head portion 3 which are disposed coaxially. Plunger portion 1 and head portion 3 are connected by neck portion 2. Head portion 3 is guided and slidably supported in an axial direction by a nose 6 which is integrally made with a mounting portion 13 for connection to the frame (not shown) of the electromagnetic hammer assembly. Nose 6 and mounting portion 13 are fastened on an outer shell yoke 4.

Plunger portion 1 is guided and slidably supported in the axial direction by a plunger guide 10 which is fastened to outer shell yoke 4. Plunger portion 1 constitutes a magnetic circuit together with outer shell yoke 4, a rear yoke 5 fixed to outer shell yoke 4, and a coil 9. Plunger portion 1 has a front face 17 which acts as a magnetism introducing face and also acts as a mounting seat for mounting a spring 7 along with the inside surface of nose 6. Spring 7 biases hammer 16 in the direction of arrow 18 (FIG. 2). As a result of spring 7 hammer 16 is normally positioned against a damper 11 which is constructed of an elastic material and which is mounted in a rear frame 12 fastened to outer shell yoke 4.

Figure 3:
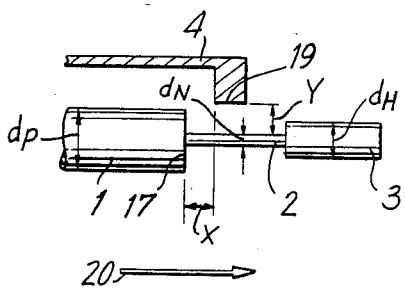
FIG. 3 is a partial schematic view of the hammer assembly and housing illustrated in FIG. 2.
Figure 1:
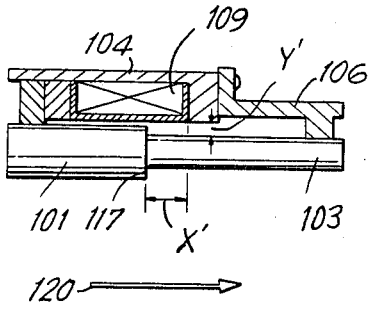
FIG. 1 PRIOR ART
FIG. 1 is a cross-sectional view of a hammer assembly constructed in accordance with the prior art.

When a pulsating voltage is applied to coil 9, an electromagnetic force is generated, and the magnetic flux emitted from a magnetic flux emitting face 19 on outer shell yoke 4 is introduced to front face 17 of plunger portion 1, thereby thrusting plunger 1 in the direction of arrow 20 (FIG.3). Head portion 3 impacts against a type 14 causing type 14 to impact against a print paper 21 which is arranged on a platen 15.

After this printing operation, and with the coil no longer supplied with a voltage, plunger portion 1 no longer is thrust in the direction of arrow 20. As a result the biasing force of spring 7, in addition to the repulsive force of platen 15, causes hammer 16 to slide back in the direction of arrow 18 (FIG.2) until it rests against damper 11 awaiting the next pulse voltage applied to coil 9.

Reference is next made to FIG. 3 wherein the relationship in positions and sizes of hammer 16 and outer shell yoke 4 are depicted. The diameter $d_N$ of neck portion 2 is smaller than the diameter $d_H$ of head portion 3 and than the diameter $d_p$ of the plunger portion 1. In FIG. 3, the diameter $d_H$ of the head portion 3 is smaller than the diameter $d_p$ of the plunger portion 1. However, the diameter $d_H$ of the head portion 3 may be the same as or larger than the diameter $d_p$ of the plunger portion 1. The radial distance Y between magnetic flux emitting face 19 of outer shell yoke 4 and the outer circumference of neck portion 2 is made larger than the longitudinal distance X between magnetic flux emitting face 19 and magnetic flux introducing face 17 when hammer member 16 is in its standby position as shown in FIG. 2. This relationship can be expressed as $Y>X$.

As a result of this configuration, the magnetic resistance between magnetic flux emitting face 19 and magnetic flux introducing face 17 is less than the magnetic resistance between magnetic flux emitting face 19 and neck portion 2, or the magnetic resistance between magnetic flux emitting face 19 and head portion 3. Thus, most of the magnetic flux generated by the voltage pulses in coil 9 do not leak into neck portion 2 or head portion 3. Rather, they are introduced into magnetic introducing face 17 so as to contribute to the thrust of hammer 16 towards type 14.

As mentioned above, hammer 16 according to the present invention is formed with a neck portion 2 having a smaller diameter than plunger portion 1 and head portion 3. As a result the magnetic flux contributed to the thrust of hammer 16 is augmented thereby improving the efficiency of the plunger type electromagnetic hammer assembly constructed in accordance with the invention. As a result, the heat released is lessened and high impact energy with low power consumption is generated, also improving the responsiveness of the print hammer.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A plunger type electromagnetic hammer assembly for impacting onto a platen in a printer comprising:

a housing formed with a yoke having a central elongated opening, said opening having a magnetic flux emitting surface;

coil means for generating magnetic flux inside the central elongated opening of the yoke;

elongated hammer means formed with a plunger portion having a first cross-sectional dimension and an impact heat portion having a second cross-sectional dimension, said plunger portion and said head portion coupled by a neck portion having a third cross-sectional dimension, said third cross-sectional dimension being smaller than said first dimension and than said second dimension, said plunger, neck and head portions being coaxially oriented, the plunger, neck and head portions all being integrally constructed from the same electromagnetic material; and the distance between the magnetic flux emitting means for reducing flux leakage from said flux emitting surface to the neck portion, said last mentioned means comprising maintaining, said closest surface being directly

2. The hammer assembly of claim 1, wherein the hammer means is substantially cylindrical in shape, the radius of the plunger portion is greater than the radius of the head portion and the radius of the head portion is greater than the radius of the neck portion.

3. The hammer assembly of claim 1, wherein the biasing means is a spring.

4. The hammer assembly of claim 1 further including guide members for slidably supporting the head portion and the plunger portion.

5. The hammer assembly of claim 1, further including damper means for damping the motion away from the printer when magnetic flux is not present on the magnetic flux emitting surface.

6. The hammer assembly of claim 1, wherein the second cross-sectional dimension is smaller than the first cross-sectional dimension.

7. The hammer assembly of claim 1, wherein the second cross-sectional dimension is larger than the first cross-sectional dimension.

* * * * *